United States Patent [19]

Maisch et al.

[11] 4,258,682

[45] Mar. 31, 1981

[54] SWITCHING CONTROL CIRCUIT, ESPECIALLY FOR MOTOR VEHICLE ENGINES

[75] Inventors: Wolfgang Maisch, Ville d'Avray; Alain Constanty, Arnouville-les-Gonesse, both of France

[73] Assignee: Robert Bosch GmbH, Stuttgart, Fed. Rep. of Germany

[21] Appl. No.: 794,885

[22] Filed: May 9, 1977

[30] Foreign Application Priority Data

May 7, 1976 [DE] Fed. Rep. of Germany ..... 2620181

[51] Int. Cl.[3] ..... F02D 33/00

[52] U.S. Cl. ..... 123/333; 123/198 DB

[58] Field of Search ..... 123/32 EA, 32 EL, 198 DB, 123/198 F, 198 D, 97 B, 102

[56] References Cited

U.S. PATENT DOCUMENTS

| | | | |
|---|---|---|---|
| 2,084,426 | 6/1937 | Berry | 123/119 EC |
| 3,430,616 | 3/1969 | Glockler et al. | 123/32 EA |
| 3,570,460 | 3/1971 | Rabus | 123/32 EL |
| 3,596,640 | 8/1971 | Bloomfield | 123/32 EL |
| 3,612,013 | 10/1971 | Gambill | 123/32 EL |
| 3,794,003 | 2/1974 | Reddy | 123/32 EA |
| 3,796,197 | 3/1974 | Locher et al. | 123/32 EA |
| 3,809,028 | 5/1974 | Luchaco | 123/32 EC |
| 3,916,170 | 10/1975 | Norimatsu et al. | 123/32 EE |
| 3,916,865 | 10/1975 | Kiencke et al. | 123/198 DB |
| 4,064,844 | 12/1977 | Matsumoto et al. | 123/32 EA |

*Primary Examiner*—S. A. Cangialosi

*Attorney, Agent, or Firm*—Edwin E. Greigg

[57] ABSTRACT

The actuation of electromagnetic devices, especially fuel or mixture shut-off solenoid valves in internal combustion engines is controlled on the basis of two engine variables, namely engine speed (rpm) and induction tube vacuum, for the purpose of suppressing fuel or mixture admission to the engine when the engine is being operated at higher than normal idling speed and while the throttle is closed (engine vacuum high). These twin conditions indicate that the engine is used for braking, i.e., it is being overrun. The position of the throttle is sensed by a vacuum switch which responds to induction tube vacuum and releases the actuation of the solenoid valve. The solenoid valve is further engaged by an rpm-dependent circuit in which a capacitor is periodically discharged by rpm related pulses.

14 Claims, 4 Drawing Figures

SWITCHING CONTROL CIRCUIT, ESPECIALLY FOR MOTOR VEHICLE ENGINES

BACKGROUND OF THE INVENTION

The invention relates to an apparatus for the reliable switching of elements, especially of electromagnetic injection valves or electromagnetic devices for the shut-off of fuel supply during engine braking, for example during downhill operation, e.g., in carburetors which have a mechanism for shutting off the idling fuel quantity. The actuating solenoid of the magnetic valve is connected in series with a semiconductor element including a driver stage.

It is known to equip carburetors of internal combustion engines with idle cut-off valves, the purpose of which is to interrupt the fuel supply through the idling nozzle of the carburetor when the ignition is turned off and thus to prevent dieseling of the engine, i.e., the continued operation after ignition shut-off.

It is also known to so control the fuel injection valves of engines equipped with fuel injection systems that the actuating solenoid of the valve is in series with a semiconductor element, usually a transistor. Also known are carburetors in which the idling mixture is shut off instead of the idling fuel when ignition is cut. Such a mixture shut-off valve requires a relatively large flow cross section and therefore a considerable magnetic power so as to permit opening this valve in normal operation against the force exerted by the induction tube vacuum.

OBJECT AND SUMMARY OF THE INVENTION

The invention is based on fuel or mixture cut-off valves already present in internal combustion engines and has as its primary object to shut off the fuel or mixture supply during engine overrunning, for example during downhill operation, or deceleration in gear, and thus at engine speeds lying above the idling rpm of the engine.

It is a further object of the invention to provide this fuel or mixture shut-off in a simple and a generally usable manner so as to permit retro-fitting of existing carburetors of virtually any type.

It is of particular significance in the description of this present invention that the two essential operational parameters which define engine braking, i.e., deceleration in gear, are a closed throttle valve (the gas pedal is not depressed) and an engine speed (rpm) which is above idling rpm and that these two parameters are reliably detected.

These objects are attained according to the invention by providing an rpm-sensitive prestage or primary circuit which responds when a lower rpm limit is reached and which actuates the solenoid valve for fuel or mixture shut-off. The invention further provides a vacuum switch associated with the driver stage or circuit of the device and actuated by induction tube pressure for sensing the existence of the condition "throttle valve open" and to cause actuation of the solenoid valve so as to permit release of the idling fuel quantity or the idling mixture.

The use of a vacuum switch for determining the throttle valve position is especially advantageous because the same constructional element can be used for virtually all types of carburetors. If, on the other hand, a mechanical electrical contact with insulated contact points is used in connection with the idling adjustment screw of carburetors, it will be necessary to provide a very large number of different types because of the large number of different throttle valve stop screws, the lengths of the idling screws, their thicknesses and thread pitches, etc. Furthermore, the use of a vacuum switch avoids any problems related to material fatigue such as would be encountered in cable linkage moving with the gas pedal. It is also important to notice that the environmental conditions placed on exhaust gas effluents do not permit an adjustment of the idling screw of modern carburetors so that any retro-fitting of a fuel shut-off device, such as according to the present invention, would have to take the place of the already present screw-type contact and thus would require a change of the idling adjustment of the carburetor. Still further, a vacuum switch recognizes the throttle valve position even if the internal conditions in the carburetor have been changed by automatic fuel mixture controls which would no longer permit their recognition by a screw-type mechanical contact.

A primary requirement of the present invention is to cause fuel or mixture shut-off in the overrunning operation of the vehicle only if two separate conditions are fulfilled, namely a. the gas pedal of the engine is released and the throttle valve is closed;

b. the engine speed (rpm) is above a predetermined limiting rpm and this limiting rpm is above the normal idling speed of the engine.

The condition "a" is sensed by the vacuum switch, while the engine speed is sensed by an rpm-sensitive prestage, or primary circuit which insures that the fuel or mixture supply is not interrupted when the engine is actually idling, i.e., without being engaged in engine braking.

Inasmuch as the present invention may be used for mixture shut-off in engines having carburetors, it may be used to encompass virtually any commonly used type of carburetor.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
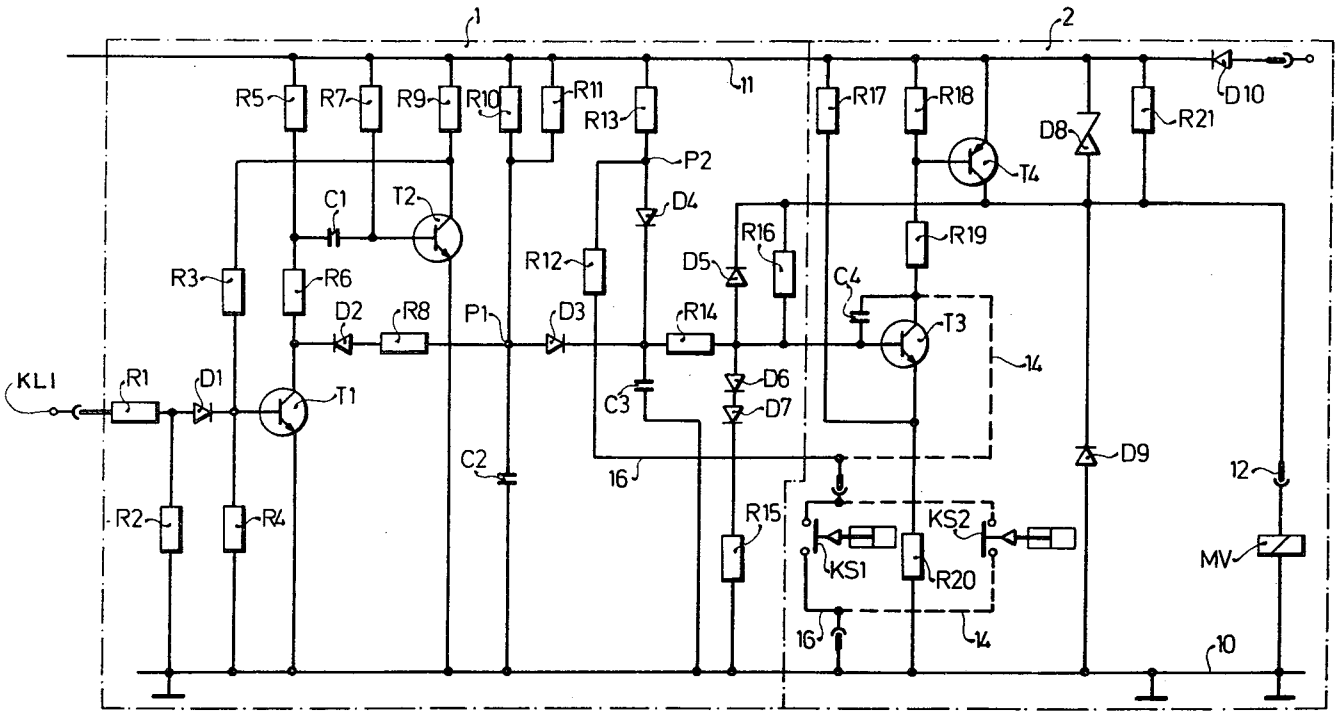
FIG. 1 is a first exemplary embodiment of a detailed circuit for engine braking shut-off, with a relatively complex rpm detector stage which responds exclusively to the frequency of the ignition pulses and wherein the magnetic valve is used substantially for idling fuel shut-off.

Turning now to FIG. 1, there will be seen a circuit diagram of a device for fuel or mixture shut-off during engine braking. It will be understood that a multitude of the individual circuit elements shown are not absolutely required for the operation in principle. Furthermore, the indicated polarities and the types of semiconductor elements which have been chosen to provide a clear understanding may obviously be replaced by those of opposite or complementary polarity, for example a PNP transistor may be replaced by an NPN transistor in consistent manner.

The circuit illustrated in FIG. 1 has a prestage region 1 and a subsequent output region or circuit 2 including the magnetic valve MV which is connected in series with the collector-emitter path of the transistor T4 between the two voltage supply lines, i.e., the negative line 10 and the positive line 11. For definiteness, it should be mentioned that, in the present embodiment, the magnetic valve MV blocks the fuel or mixture supply through the idling system of a carburetor when it is unenergized, i.e., without current, whereas it releases the fuel or mixture supply when it is actuated so that a current flows through the actuating coil of the magnetic valve MV.

Figure 3:
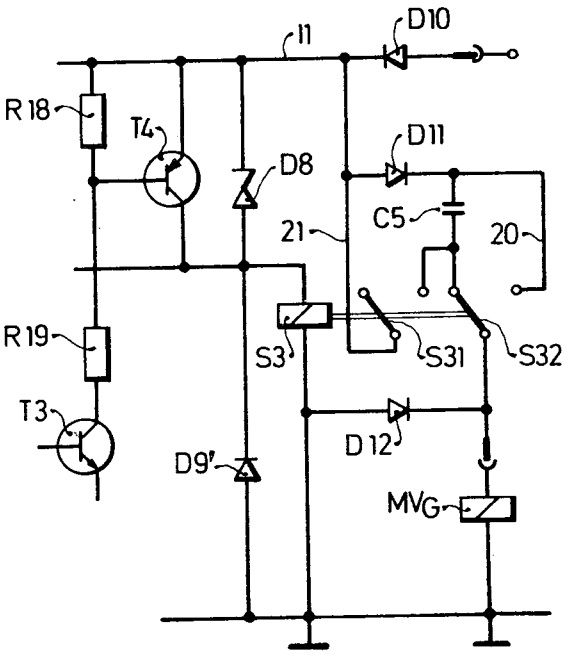
FIG. 3 is a portion of a circuit for the final stage of controlling an idling mixture shut-off valve wherein the driver and prestage circuitry is identical to that of FIG. 1.

As already explained, the magnetic valve MV or a suitable substitute, for example the magnetic valve $MV_G$ of FIG. 3, is to be so controlled that fuel or mixture supply is shut off when certain operational parameters occur. These operational parameters are so chosen as to encompass the overrunning, i.e., engine braking, domain of the vehicle, i.e., a condition in which the throttle valve of the engine is closed but the motor is coupled to the running gear of the vehicle and is being operated at a relatively high speed, for example during downhill operation. When the fuel is shut off during such operation, considerable fuel savings result, for example the fuel savings may be between 5% to 7% without detracting from the quality of the exhaust gas.

Figure 2:
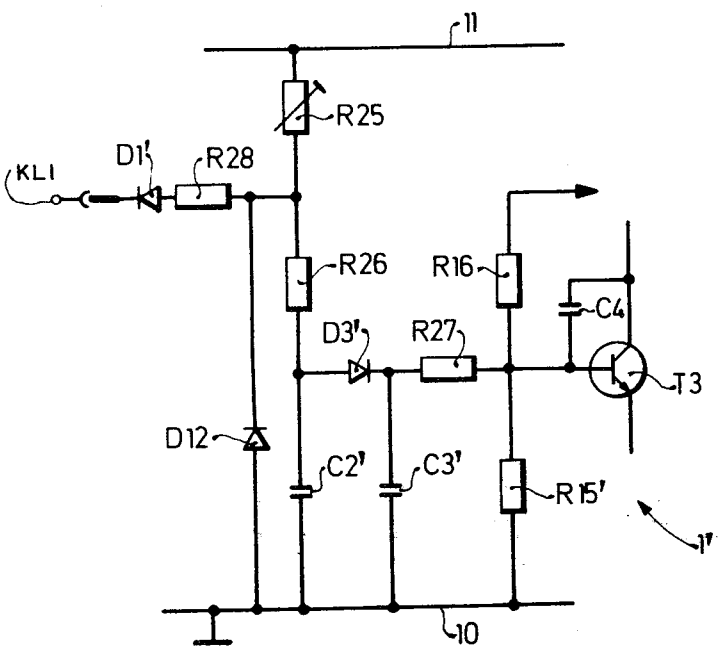
FIG. 2 is a simply constructed rpm-sensitive detector stage.

The primary circuit 1 of FIG. 1 or that of FIG. 2 supplies a positive voltage of varying magnitude to the driver transistor T3. When the rpm is sufficiently low (i.e., in the vicinity of the idling rpm), the voltage fed to the driver transistor T3 is sufficiently positive to cause that transistor to conduct, thereby also rendering the subsequent transistor T4 conducting and actuating the magnetic valve MV, thereby releasing the supply of fuel. The driver transistor T3 is also coupled to a vacuum switch S1 or S2. The vacuum switch S1 is normally closed, whereas the vacuum switch S2, which may also be used, is of the type which is normally open.

The output circuit 2 is constructed as follows. The emitter of the driver transistor T3 is connected through a resistor R20 to the negative supply line 10 and its collector is connected through resistors R18 and R19 to the positive line 11. The junction of these two resistors is connected to the base of the transistor T4 whose emitter is directly coupled to the positive supply line 11 and whose collector is connected to the magnetic valve MV, the other electrode of which is grounded or connected to the negative supply line 10. A protective resistor in series with the magnetic valve is not present because the valve is sufficiently protected by a portion of the circuit which includes the resistor R21 which lies between the line 11 and the collector of T4 and the diode D5 which is connected to the base of the transistor T3. Thus, if the loose valve plug 12 is accidentally grounded, the magnetic valve is protected because in that case, the diode D5 connects the base of the driver transistor T3 directly to ground which blocks it as well as the subsequent transistor T4. The presence of the resistor R21 insures that the cathode voltage of the diode D5 is normally so high as to block it so that it does not interfere with the operation of the switch formed by transistors T3 and T4.

A first possibility of connecting the vacuum switch S2 is shown in that the contact KS2 connects the collector of T3 to the minus line 10 when the switch S2 is closed. The switch S2 is closed whenever the throttle valve is even slightly opened. If the throttle valve is completely closed however, the contacts KS2 are opened so that the switch S2 does not affect the control of the output stage 2 which is then entirely determined by the primary circuit 1.

If, however, the gas pedal is even slightly depressed the contacts KS2 are closed because the induction tube vacuum will then be greater than, for example, 50 mbar. In that case, the output transistor T4 is rendered conducting independent of engine speed, thereby actuating the magnetic valve MV and releasing or permitting the flow of the idling fuel quantity. In this manner, the engine may be immediately provided with the idling fuel quantity when the gas pedal is actuated after engine braking. If, on the other hand, the gas pedal is released and the engine speed is sufficiently high, the idling fuel quantity is interrupted.

The output stage 2 of FIG. 1 contains further elements, namely, a resistor R17 in series with the emitter resistor R20 for raising the emitter voltage of T3 so as to permit its conduction only when the base voltage is several times as large as the base-emitter voltage of approximately 0.7 volt. In this manner, even if the base emitter voltage of the driver transistor T3 fluctuates widely due to temperature changes it will not have any effect on the operation of the circuit. Another advantage of this connection is that the input KL1 of the circuit in FIG. 2 can be tied to the collector of the ignition transistor of a fully electronic transistor ignition circuit which has a switching voltage of at least 1.5 volts.

Connected in parallel with the collector-emitter path of the output transistor T4 is a Zener diode D8 which protects the transistor against spurious voltage peaks; in similar manner a diode D9 connected in anti-parallel fashion with respect to the actuating windings of the magnetic valve MV prevents voltage peaks when the magnetic valve is shut off. The diode D10 in the positive supply line 11 is intended to protect the circuit during accidental exchange of the battery polarities. The function of the other vacuum switch with the normally closed contacts KS1 will be explained in connection with the explanation of the preliminary circuit 1'.

The preliminary circuit 1' is constructed most simply as illustrated in FIG. 2; in that case it consists of the series connection of an adjustable resistor R25 with a further resistor R26 and a capacitor C2', all connected between the two voltage supply rails 10 and 11. The junction of the resistor R26 and the capacitor C2' is connected via a positive-passing diode D3 to the junction of a capacitor C3' and a resistor R27, the opposite electrode of the capacitor C3' being grounded. The other electrode of the resistor R27 is connected to the base of the driver transistor T3. The preliminary circuit 1' of FIG. 2 has an input contact KL1 which is coupled either to the breaker points of a normal coil type ignition system so that the cathode of the diode D1' which connects the input contact KL1 to the junction of the resistors R25 and R26 through a further resistor R28 is periodically grounded, or else the contact KL1 may be connected to the switching point of a fully electronic transistorized ignition system; in that case it may be connected, for example, to the collector of the ignition transistor. The junction of the resistors R25 and R26 is also connected with the cathode of a diode D12, the anode of which is grounded. The method of operation of this input circuit 1' is such that the capacitor C2' is charged to positive potential through the adjustable resistor R25 and the resistor R26. Beginning with a certain positive value of the voltage, the diode D3 causes a rectification of the peak and a charging of the capacitor C3'. The positive charging of the capacitor C2' is also affected by the magnitude of the engine rpm because, when the breaker contacts connected to the input KL1 are closed, the capacitor C2' periodically discharges. Thus the capacitor C2' can charge only when the breaker contacts of the engine are open and the charging process reaches a voltage which is higher if the engine runs more slowly, i.e., the longer the breaker contacts are open. Beginning with a certain lower limiting rpm, which is above or near the idling rpm of the engine, the capacitor C3' will have charged up to a positive voltage which permits conduction of the driver transistor T3 which, as already explained above, finally causes actuation of the magnetic valve MV and permits the delivery of the idling fuel supply.

Of special significance in this circuit of FIG. 2, is the disposition of the resistors R28 and R26 with a parallel diode D12 which prevents high frequency voltage peaks occurring in the ignition process from having a detrimental effect on the charging process of the capacitor C2'. Thus, when the engine rpm is constant, the voltage of the capacitor C3' which is charged by peak rectification through the diode D3 remains unchanged and no spurious actuation of the subsequent threshold switch takes place even when spurious voltage peaks occur in the input circuitry. A similar function is performed by the capacitor C4 which is connected across the collector and base of the driver transistor T3. It prevents erroneous actuation due to ignition-induced voltage fluctuations.

In some instances it may be desirable to replace the simple construction of the rpm detector stage for driving the threshold switch of transistors T3 and T4 by a circuit which depends exclusively on the frequency of the ignition pulses. That type of control would prevent the effects of breaker contact wear and cam follower wear of the breaker points which enters the system in the illustration of FIG. 2.

Such a substitute input circuit is illustrated in FIG. 1 which is seen to include a multivibrator formed by the transistors T1 and T2. The emitter of the transistor T1 is connected directly to the minus line 10 while its collector is connected to the positive line 11 through the series-connected resistors R6 and R5. The collector of the transistor T1 acts through the series connection of the diode D2 and the resistor R8 on a junction point P1 which is similar to the junction point of the diode D3' and the capacitor C2' of the circuit shown in FIG. 2. The base of the transistor T2 is connected through a capacitor C1 to the junction of resistors R5 and R6 and thus to the collector voltage of the transistor T1. It is further connected via a resistor R7 to the positive supply line 11. A resistor R3 provides a feedback path from the collector of T2 to the base of T1. The base of the transistor T1 is connected through a resistor R4 to the minus line 10 and also through a resistor R1 and a positively conducting diode D1 to the input contact KL1. Finally, a resistor R2 connects the junction of the resistor R1 and the diode D1 to ground and a resistor R1 is the collector resistor of the transistor T2. The capacitor C2 is charged through the parallel connection of resistor R10 and an adjustable resistor R11; furthermore the point P1 is coupled through the diode D3 with the junction of a further grounded capacitor C3 and a resistor R14, the other end of which is connected to the base of the driver transistor T3. The basic functioning of the circuit described thus far will now be discussed briefly. Whenever the input contact KL1 receives a positive pulse, the transistor T1 will be in its conducting state corresponding to the metastable state of the monostable multivibrator. Thus, a negative voltage passes from the coupling capacitor C1 to the base of the transistor T2 which blocks and maintains the transistor T1 in the conducting state. Only after the charge on the capacitor C1 has been exchanged through the resistors R6 and R7 does the metastable state of the mono flip-flop terminate, blocking the transistor T1. While the transistor T1 was conducting, the positive voltage at the point P1 was decreased through the diode D2 and the resistor R8; in other words, the capacitor C2 was discharged. It will be seen that when the engine speed (rpm) is low, for example near the idling rpm, the discharging process becomes less and less frequent so that the capacitor C2 will carry a sufficiently high voltage (with fluctuations) that the diode D3, which rectifies the voltage peaks, charges the capacitor C3 to positive voltages which turn on the transistor T3 if the rpm is sufficiently low. The time constant of the monostable multivibrator consisting of the transistors T1 and T2 is chosen to be sufficiently long to compensate for the influence of any dimensional differences in the circuit elements. For this reason, the adjustment of the rpm threshold for the re-supply of the idling fuel quantity (when transistors T3 and T4 conduct) requires only a single adjustment which is made with the aid of the resistor R11. The resistor R16 in parallel with the diode D5 serves for the setting of a desired rpm hysteresis, whereby constant back and forth switching processes are avoided when the rpm fluctuates only slightly or the voltage at the capacitor C3 fluctuates somewhat.

It has already been explained that the vacuum switch can also be embodied as a normally closed contact as illustrated in FIG. 1. In that case, the switch S1 opens its contacts KS1 whenever the throttle valve is even slightly opened, i.e., when the desired vacuum in the induction tube is reached. This switch and its connection is to be regarded as alternative to that illustrated by the dashed lines and includes the line 16 which connects the circuit point P2 to ground through the vacuum contacts KS1 and the resistor R12. The circuit point P2 lies at the junction of a resistor R13 connected to the positive supply line and a diode D4, the cathode of which is connected to the capacitor C3. It will be appreciated that when the vacuum switch S1 is open (gas pedal depressed and throttle valve open) the voltage at the point P2 is free to float so that the series connected resistor R13 and the diode D4 immediately supply the base of the driver transistor T3 with a positive voltage, permitting the magnetic valve MV to be actuated so as to release the idling fuel quantity. By contrast, if the throttle valve is closed, the contacts KS1 of the switch S1 are also closed so that the diode D4 blocks and the branch R13, D4 no longer influences the voltage at the capacitor C3 and this voltage is then determined exclusively by the function of the rpm-sensitive primary circuit 1, i.e., by the engine speed. The series-connected diodes D6 and D7 in series with the base drain resistor R15 serve for temperature and voltage compensation and for the further purpose of shifting the switching threshold slightly upward when the temperature decreases so that, when the temperature is low and the internal engine resistance is high and while a portion of the fuel condenses on the walls of the induction tube, the idling fuel quantity is re-supplied at a higher rpm than otherwise. If the circuit according to the present invention is to be used for the suppression of the idling fuel mixture (as opposed to the idling fuel quantity), during engine braking, it will be advantageously coupled to the magnetic valve already present in many carburetors for the purpose of closing a large flow aperture. A valve of this type is labeled $MV_G$ in FIG. 3 and requires a higher magnetic force than a valve used for fuel shut-off. For this reason, the output portion of the circuit of FIG. 1 is advantageously substituted for by that illustrated in FIG. 3 in which the magnetic valve is shown not to be controlled directly by the output transistor T4 but via a relay S3 having two switching contacts S31 and S32. In other respects, the control circuit for the driver transistor T3 is the same as was the case in FIGS. 1 or 2; the collector-emitter path of the transistor T4 is connected in series with the actuating winding of the relay S3. In the position of the switching contacts S31 and S32 illustrated in FIG. 3 in which the relay S3 is currentless and the transistor T4 is blocked, the magnetic valve $MV_G$ to which a quenching diode D12 is connected in parallel, is connected with a capacitor C5 lying in series with a diode D11 and the positive supply line 11. In this position, the idling mixture is shut off and the magnetic valve $MV_G$ is unenergized, and the capacitor C5 is charged up through the windings of the valve $MV_G$ to the level of the supply voltage, i.e., battery voltage. If the relay is actuated, twice the battery voltage will be available for the short time for actuating the valve $MV_G$, for, as will be seen, the magnetic valve $MV_G$ then is connected through the switched-over contact S32, the line 20, the capacitor C5 charged to battery voltage, the switched-over contact S31 and the line 21 to the positive supply line 11 and thus receives a higher than battery voltage until the capacitor C5 has had an opportunity to be discharged. After that discharge, the static holding current for the windings of the magnetic valve $MV_G$ continues to flow through the diode D11 as long as the relay S3 is actuated during the conduction of the transistor T4.

Figure 4:
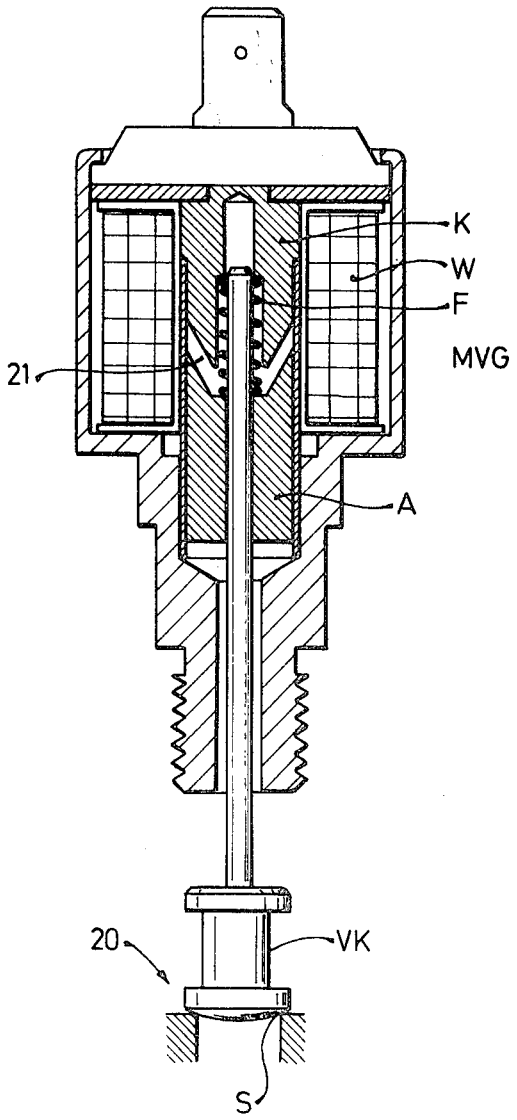
FIG. 4 is an illustration of a shut-off valve for idling mixture shut-off.

FIG. 4 illustrates another way to increase the power of the magnetic valve for idling mixture shut-off. The per se known mixture shut-off valve $MV_G$ includes a winding W with a core K and an armature A which is urged by a spring F away from the core so that, as illustrated in FIG. 4 with the numeral 20, a valve member VK remains on its cooperating seat S and prevents the flow of either fuel or mixture. The attractive power of the valve magnet is increased by shaping the magnet core and the armature with conical surfaces 21 which substantially increases the pulling power over that of a magnet with flat faces. This construction and the increase of the voltage previously described with the aid of the capacitor C5 results in a magnetic force which is sufficiently great to open the valve in opposition to the suction of the vacuum during engine braking (the static pressure behind the throttle plate). The voltage for the overall circuit does not have to be stabilized because the threshold voltage at the base of the driver transistor T3 changes in the same manner as the rpm-dependent voltage at the peak rectifying capacitor C3.

It should be understood that a circuit of the type described which reacts to external operational parameters can also be used to affect or control other control elements than described, especially those of electromagnetic type.

If a normally closed switch S1 with contacts KS1 is used for engaging the control side of the driver transistor T3, the fuel supply is not blocked immediately at the time of gas pedal release (throttle plate closure) but only after a certain delay of for example between 1 and 2 seconds. Such a delay may be desirable to prevent the supply of idling fuel when it is intended merely to change gears, for example.

The foregoing relates to preferred exemplary embodiments and variants of the invention, it being understood that other embodiments and variants thereof are possible within the spirit and scope of the invention.

We claim:

1. In a fuel supply carburetor system of an internal combustion engine, the engine having a throttle valve and a system including:

normal fuel administering means;

separate electromagnetic shut-off means which functions independently of said fuel administering means and arranged for interrupting the flow of a combustible substance to the engine cylinders; and electrical means connected to said electromagnetic valve shut-off means, for actuating said electromagnetic valve shut-off means; the improvement comprising: an apparatus for actuating the electromagnetic valve shut-off means when the engine speed is above a predetermined speed, which speed is above the idle speed of the engine, and when the throttle valve is closed, to thereby produce the noted flow interruption, the apparatus comprising:

a primary circuit connected to receive signals related to engine speed (rpm) and including electrical charging and discharging means which generate a signal for continuously closing said electromagnetic valve means in the event the engine speed is above said predetermined speed; p1 a driver circuit connected to the primary circuit;

a power switching circuit connected in series with said electromagnetic valve shut-off means, and responsive to said driver circuit; and vacuum operated switch means connected to the driver circuit, said vacuum operated switch means being disposed to sense induction tube pressure upstream of the throttle valve when the throttle valve is in a closed position and thereby the position of the throttle valve, and generating a signal for opening said electromagnetic valve shut-off means in the event the induction tube pressure indicates an open position of said throttle valve, wherein the electromagnetic valve shut-off means in a first instance is actuated through the driver circuit and produces the noted flow interruption when the primary circuit receives a speed signal indicating that the engine speed is greater than said predetermined speed and the throttle valve is closed; and further wherein the electromagnetic valve shut-off means in a second instance interrupts the flow of fuel upon shut-off of said electrical means; and further wherein the electromagnetic valve shut-off means in a third instance allows fuel flow when the engine speed is above the predetermined speed and when the throttle valve is open.

2. An apparatus as defined by claim 1, wherein said electric charging and discharging means includes a first capacitor and a second capacitor, wherein said primary circuit further includes a plurality of resistors, through which the first capacitor is charged, circuit means for discharging the first capacitor at a rate dependent on engine rpm, and a diode, said first and second capacitors being connected through said diode to said driver circuit, and wherein said driver circuit includes a driver transistor and an output transistor controlled by the driver transistor, the base of said driver transistor being connected to said second capacitor; whereby the base of said driver transistor receives a voltage which increases with decreasing engine rpm.

3. An apparatus as defined by claim 2, wherein said first capacitor is charged from the supply voltage of said primary circuit through two series connected resistors, the junction of which is connected through an input diode to the ignition breaker contacts of the engine and wherein said junction is connected to ground through a diode inhibiting current flow to the other voltage supply line of said circuit.

4. An apparatus as defined by claim 2, wherein the emitter of said driver transistor is connected to a supply line of the circuit through an emitter resistor and wherein the junction of said emitter resistor and said emitter of said driver transistor is connected to the positive voltage line of said circuit through a further resistor (R17).

5. An apparatus as defined by claim 2, wherein said circuit means for discharging said capacitor is a monostable multivibrator which is triggered by positive pulses into a metastable state in which it discharges said first capacitor.

6. An apparatus as defined by claim 5, wherein said monostable multivibrator includes two transistors (T1,T2) the collector and base of which are mutually coupled in known manner through a capacitor and a resistor respectively, and wherein the collector of the transistor (T1) which conducts in the unstable state of said monostable multivibrator is connected to said first capacitor.

7. An apparatus as defined by claim 1, wherein said electronic means includes an output transistor controlled by a driver transistor and wherein the collector of said output transistor is connected with the actuating winding of said electromagnetic shut-off means, and the base of said output transistor is connected preferably via two resistors (R18,R19) to the collector of said driver transistor; whereby when the base voltage of said driver transistor is sufficiently positive, corresponding to a relatively low engine rpm, said driver transistor and said output transistor both conduct and said electromagnetic valve shut-off means is actuated to release said combustible substance to said engine cylinders to maintain at least low speed operation of said engine.

8. An apparatus as defined by claim 1, wherein said electronic means includes an output transistor connected to said electromagnetic valve shut-off means and a driver transistor connected to control said output transistor, and wherein said vacuum operated switch means includes contacts which are closed when the throttle plate of said engine is at least partially opened and wherein said contacts connect the collector of said driver transistor with a voltage causing conduction of said output transistor.

9. An apparatus as defined by claim 1, wherein said electronic means includes an output transistor connected to said electromagnetic valve shut-off means and a driver transistor connected to control said output transistor and wherein said vacuum switch means includes contacts which are closed when the throttle plate of said engine is closed, and wherein said primary circuit includes a first capacitor and a second capacitor coupled together through a diode, said second capacitor being connected to control the base of said driver transistor, and wherein said contacts inhibit the conduction of positive voltage to said second capacitor; whereby the switching of said driver transistor is determined exclusively by said primary circuit.

10. An apparatus as defined by claim 9, wherein the electrode of said second capacitor connected to the base of said driver transistor is also connected through a diode (D4) and a resistor (R13) to the positive supply line of said circuit, and wherein the junction of said diode (D4) and said resistor (R13) may be connected to ground through said contacts of said vacuum operated switch means.

11. An apparatus as defined by claim 1, wherein said electronic means includes an output transistor connected to said electromagnetic valve shut-off means and a driver transistor connected to control said output transistor, and wherein the collector of said output transistor is connected through a diode to the base of said driver transistor and is also connected through a resistor (R21) with the positive supply line of the circuit, whereby when the collector line of said output transistor is accidentally grounded, the current flow through said output transistor is interrupted and prevents its destruction.

12. An apparatus as defined by claim 1, wherein said combustible substance is the fuel-air mixture of the engine and wherein said electronic means includes a relay having two sets of contacts, one set of contacts being connected to said electromagnetic valve shut-off means, and an output transistor for actuating said relay, a driver transistor connected to control said output transistor and wherein said first set of relay contacts (31) is so connected that when said electromagnetic valve shut-off means is currentless, it is connected in series with a capacitor and a diode to the positive voltage supply line of said circuit thereby permitting charging said capacitor whereas, in the energized position of said relay, said capacitor is connected to said positive supply line and to said electromagnetic valve shut-off means in the opposite sense; whereby said electromagnetic valve temporarily receives substantially twice the battery voltage of said circuit.

13. An apparatus as defined by claim 1, wherein said electronic means includes an output transistor for actuating said electromagnetic shut-off means and a driver transistor connected to control said output transistor and wherein the base of said driver transistor is connected to ground through a resistor in series with at least one diode; whereby temperature and voltage fluctuations are compensated for.

14. An apparatus as defined by claim 13, wherein said electromagnetic valve shut-off means includes a core and a moving armature adjacent surfaces of which are conical; whereby the actuating force exerted by said electromagnetic shut-off means is increased.

* * * * *